United States Patent [19]

Garrett

[11] 4,396,234

[45] Aug. 2, 1983

[54] WELDABLE BLADE STABILIZER

[76] Inventor: William R. Garrett, 24 Palmer Dr., Conroe, Tex. 77302

[21] Appl. No.: 251,271

[22] Filed: Apr. 6, 1981

[51] Int. Cl.[3] ..... F16C 29/02

[52] U.S. Cl. ..... 308/4 A; 175/325

[58] Field of Search ..... 308/4 A, 4 R, 3 R, 4 C; 175/325

[56] References Cited

U.S. PATENT DOCUMENTS

| | | | |
|---|---|---|---|
| 2,288,124 | 6/1942 | Creighton | 308/4 |
| 4,156,374 | 5/1979 | Shwayder | 308/4 A |
| 4,277,108 | 7/1981 | Wallace | 308/4 A |
| 4,277,869 | 7/1981 | Hartwell | 308/4 A |

*Primary Examiner*—Lenard A. Footland
*Attorney, Agent, or Firm*—Vaden, Eickenroht, Thompson, Bednar & Jamison

[57] ABSTRACT

A drill string stabilizer having either an adjacent or underlying surface affixed to the high strength drill string member which is made of easily weldable material. The easily weldable material is affixed to the drill string member by weld beads under carefully controlled temperature and other environmental conditions to ensure that such weld beads do not have cracks or blemishes created therein. The weldable material permits the welding of a wear element or blade structures to be made in uncontrolled or field conditions without adverse consequences to the resulting weld beads. Low carbon steel or weld material may be such easily weldable material, neither of which are prone to cause weld cracking, even under a field welding environment. The wear element structures may be individual elements or incorporated in a partial or complete sleeve. One embodiment includes welding a portion of the wear elements to the stabilizer body, but the areas where the high stresses occur are welded to easily weldable material, which is not nearly so susceptible to cracking.

16 Claims, 7 Drawing Figures

FIG. 1
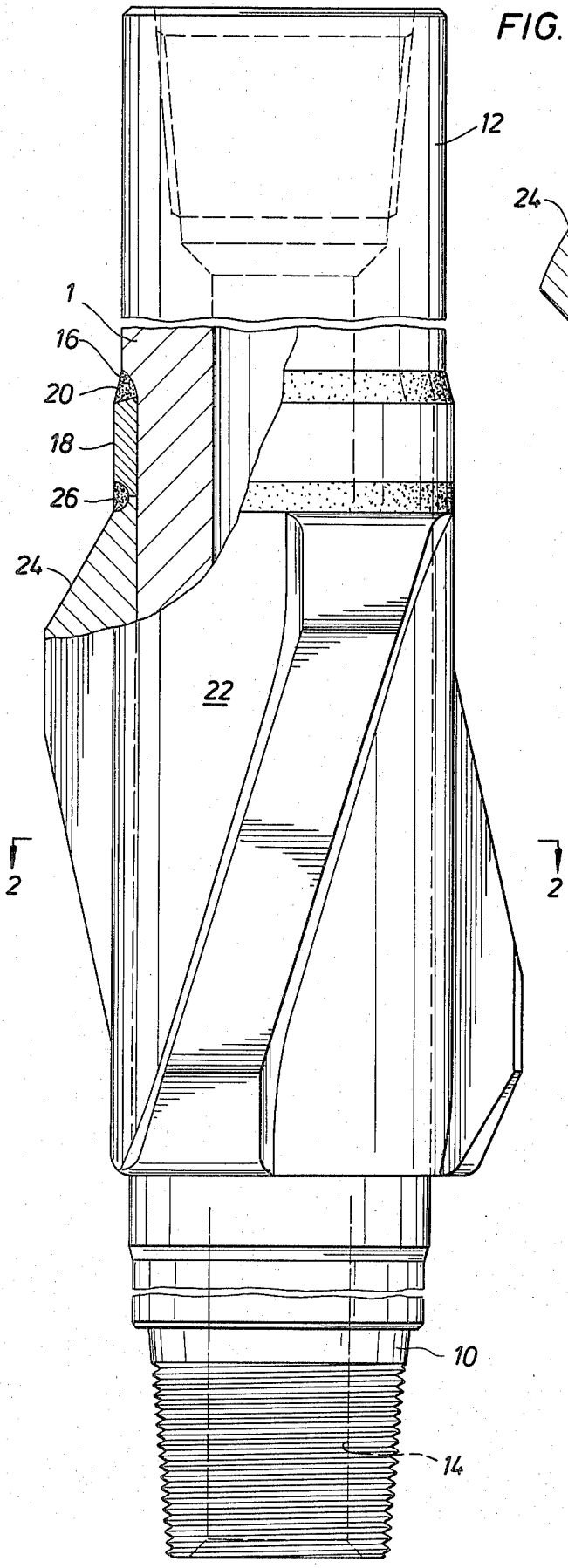
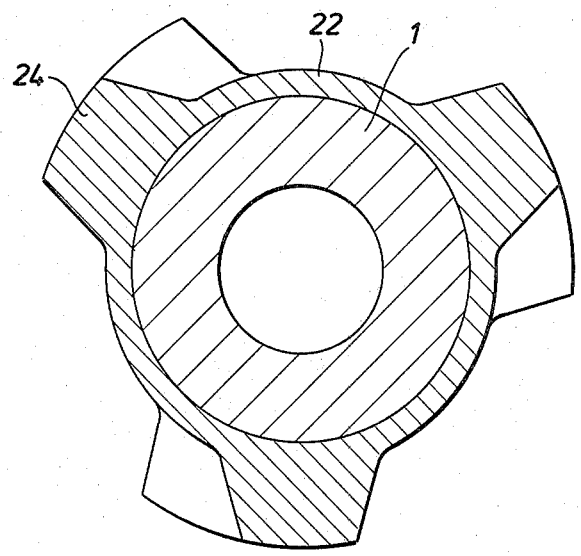
FIG. 2
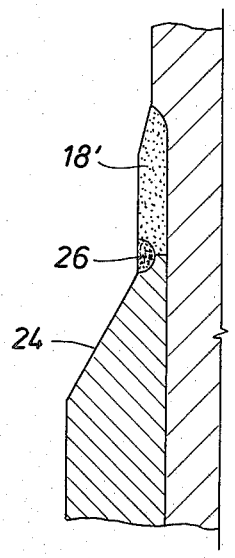
FIG. 3

FIG. 4
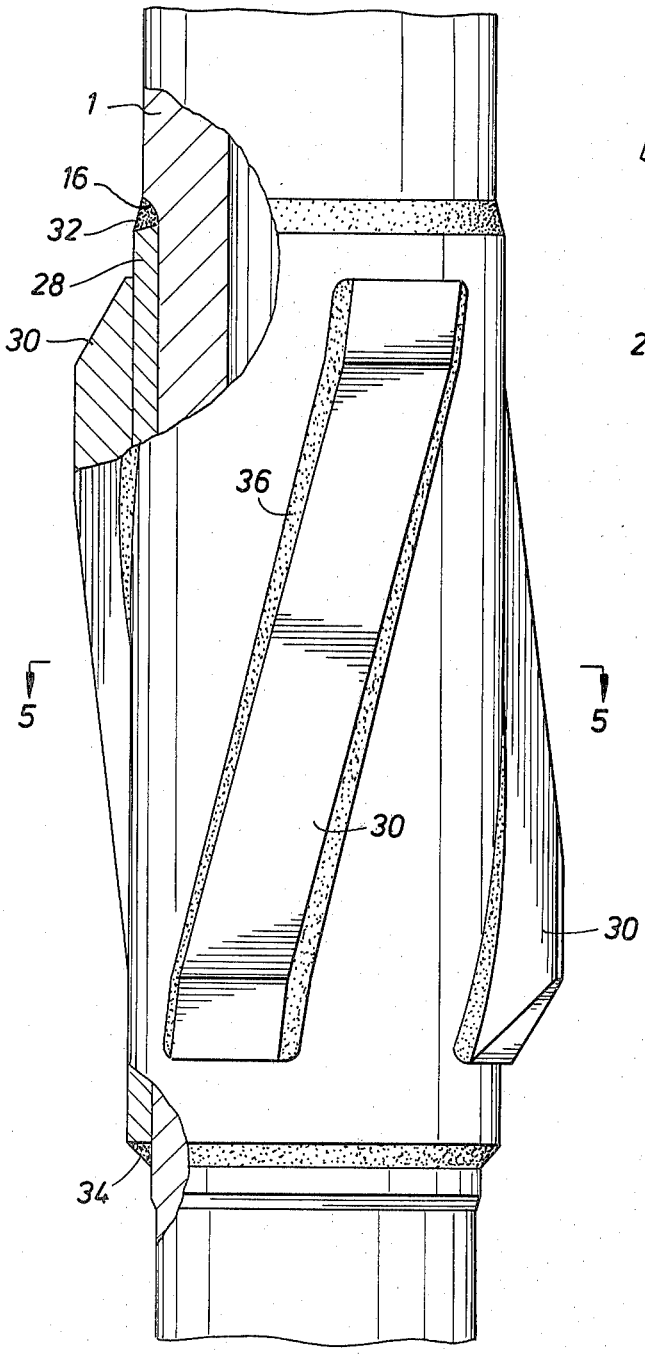
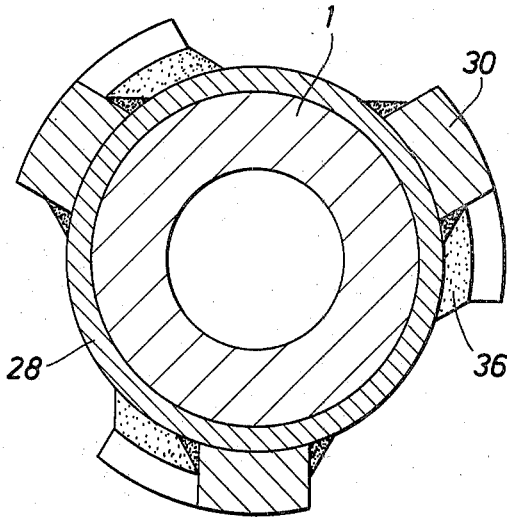
FIG. 5
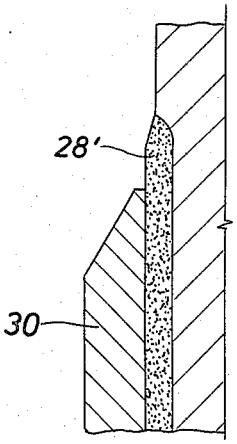
FIG. 6

WELDABLE BLADE STABILIZER

BACKGROUND OF THE INVENTION

1. Field of the Invention

This invention pertains to borehole drilling apparatus and specifically to that part of a drill string known in the industry as a stabilizer.

2. Description of the Prior Art

Stabilizers, sometimes referred to as drill collar stabilizers or as drill stem stabilizers, have been employed in earth boring operations for the petroleum industries to centralize the drill stem in the borehole, usually especially in the drill collar section at a distance of from 100 feet to 1000 feet above the drill bit. The purposes of a stabilizer are to (1) help control hole angle direction, (2) prevent the bit from drifting laterally, which would result in undesirable dog-legs and ledges, and (3) improve bit performance by forcing the bit to centrally rotate about its axis so as to provide substantially equal force loading on all three drill bit cones. In addition, stabilizers also may be used to provide a reaming function for undersized or irregularly shaped boreholes providing the formation is not too hard.

Stabilizers are categorized in the industry as rotating stabilizers and as non-rotating stabilizers. A rotating stabilizer includes wall-contacting members that rotationally track along the wall of the borehole as the drill string is turned. On the other hand, non-rotating stabilizers, one type of which is also referred to as sleeve-type stabilizers, do not rotate as the drill string is turned, its wall-contacting members merely moving around the wall of the borehole as the drill string is rotated and lowered or raised.

The contacting members of a rotating type of stabilizer, which is the type of stabilizer described herein, are subjected to the various forces attendant to the entire drill string, including thrust forces, fretting forces, and the forces applied to the drill string as a result of the drill string manipulations, the conditions of the bore, and the fluid conditions internal and external to the drill string.

Various rotating types of stabilizers include mechanisms for connecting and detaching the wear elements to provide for their replacements. Such connectable and detachable mechanisms include various slot and groove connections, cap screw connections, tapered wedging connections and combinations of the above. However, one of the most popular types of stabilizer of the rotating variety is known as the "welded-blade" stabilizer. Its popularity stems from the fact that there are no connectable mechanisms between the parts other than the permanent welds that affix the wear element, commonly known as the blade, to the drill string member.

Welded blade stabilizers in the prior art are typified by the structures shown in Ortloff et al., U.S. Pat. No. 3,263,274. The wear pads shown in the Ortloff structures are welded to the body of the tool joint; however, it should be recognized that tool joints are typically made of alloy steel which are difficult to weld in reliable fashion, particularly under field environment. That is, welding thereon can only be reliably performed in a controlled environment where the alloy steel is heated and cooled quite slowly and in a clean environmental surroundings. When welding of this type is attempted in conditions other than such a controlled environment, the alloy steel cools too quickly and results in cracking of the weld. Even when welds are made under controlled conditions, some damage is done to the alloy structural member. This damage is accumulative and irreversible. After many replacements are made the lasting damage by itself may be enough to cause the occurrence of cracks.

There are also structures in the prior art, such as shown in Creighton, U.S. Pat. No. 2,288,124, that discloses stabilizer elements held within sleeves which are, in turn, welded to the tubular body. Although there are many different structures shown in Creighton, one of which has elements welded to the surface of the protector body sleeve (facing 29 welded to body 10*c* in FIG. 8 of Creighton), there is no showing in Creighton of the use of a sleeve which is particularly suited for affixing weldable wear pads thereto.

Therefore, it is a feature of the present invention to provide a stabilizer having wear elements that are reliably affixable by welding under field conditions.

It is another feature of the present invention to provide a stabilizer with a sleeve or other suitable arrangement to permit wear-element affixing to the stabilizer tool body by welding, rather than by clamping, snapping or other releasable means.

SUMMARY OF THE INVENTION

The weldable blade stabilizer embodiments of the invention herein disclosed include replaceable, normally hard-faced wear elements for contacting the surface of the borehole when the stabilizer is in use, which elements are affixed to the stabilizer drill string memeber by welding to a readily weldable surface. In some embodiments this surface is the surface of a sleeve or partial sleeve made of low carbon steel. In other embodiments, the easily weldable surface is built-up weld metal.

BRIEF DESCRIPTION OF THE DRAWINGS

So that the manner in which the above-recited features, advantages and objects of the invention, as well as others which will become apparent, are attained and can be understood in detail, more particular description of the invention briefly summarized above may be had by reference to the embodiments thereof which are illustrated in the appended drawings, which drawings form a part of this specification. It is to be noted, however, that the appended drawings illustrate only preferred embodiments of the invention and are therefore not to be considered limiting of its scope, for the invention may admit to other equally effective embodiments.

In the Drawings

FIG. 1 is a partial longitudinal cross-sectional view of a welded blade stabilizer in accordance with a preferred embodiment of the present invention.

FIG. 2 is a cross-sectional view taken at 2—2 of FIG. 1.

FIG. 3 is a partial longitudinal cross-sectional view of a segment of another embodiment of a welded blade stabilizer in accordance with the present invention.

FIG. 4 is a partial longitudinal cross-sectional view of a welded blade stabilizer in accordance with yet another embodiment of the present invention.

FIG. 5 is a cross-sectional view taken at 5—5 of FIG. 4.

FIG. 6 is a partial longitudinal cross-sectional view of a segment of still another embodiment of a welded blade stabilizer in accordance with the present invention.

DESCRIPTION OF PREFERRED EMBODIMENTS

Figure 7:
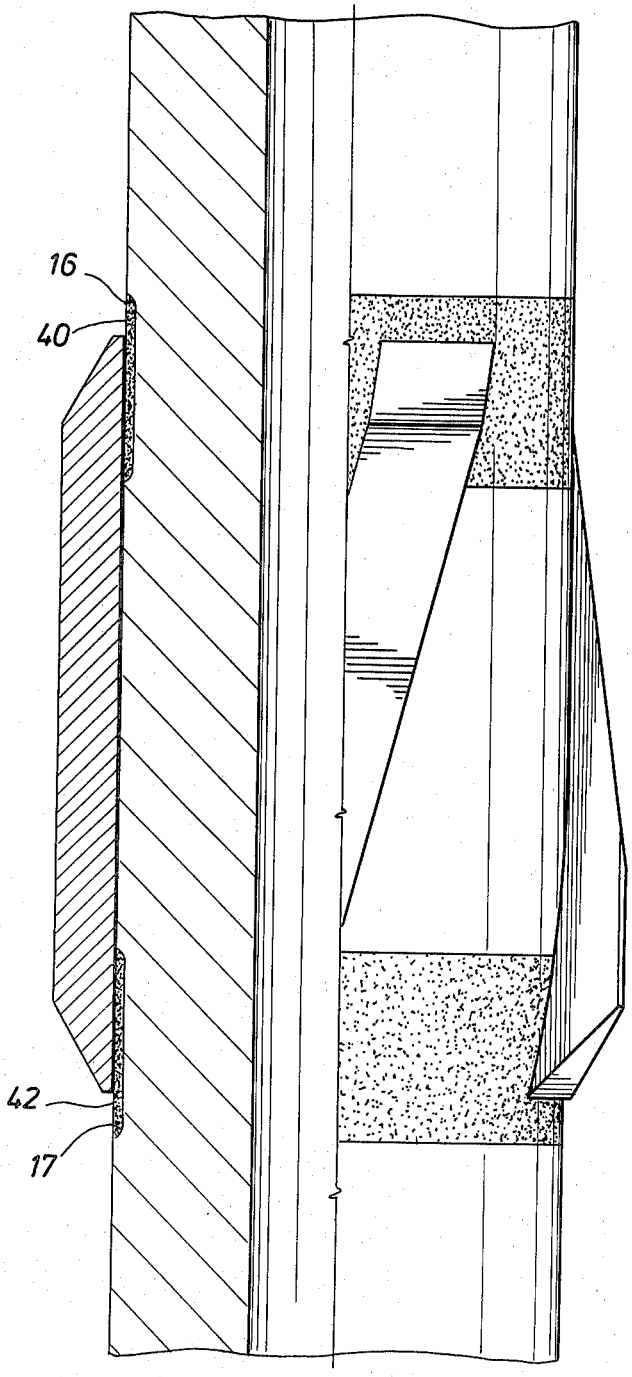
FIG. 7 is a partial longitudinal cross-sectional view of a segment of yet another embodiment of a welded blade stabilizer in accordance with the present invention.

Now referring to the drawings, and first to FIG. 1, a stabilizer in accordance with the present invention is shown in longitudinal cross-section. Body 1 of the illustrated stabilizer tool is threaded for suitable connection to adjoining members cooperatively threaded therewith in the drill string. As illustrated, pin end 10 of the drill string member is toward the bottom and box end 12 is toward the top. The body of the stabilizer includes a fluid circulation hole 14 therethrough and is normally screwed into the drill string in connection with the collar section. Generally, such a section is located 100–1000 feet above the bit. However, a stabilizer tool may be located in other and additional locations in the string. Nothing herein limits the location of the stabilizer to any particular location.

The wear elements or blades of a stabilizer extend beyond the periphery of the tool body to which they are attached and bear against the inside surface of the borehole in which the tool is used. The blades are spaced apart from one another to permit fluid circulation therebetween. There is a shoulder 16 just below the location where the blades are to be affixed. The tool circumference above below this shoulder is enlarged with respect to the circumference below this shoulder. A short sleeve 18 of easily weldable material, typically a low carbon steel, is slipped over the bottom or pin end of the tool and positioned adjacent shoulder 16. The inside diameter of the sleeve fits snugly around the external circumference of body 1 at this position. Such a sleeve can be shrunk on by a preheating process or can be made to close tolerance for its snug fitting. Sleeve 18 is then carefully welded in place by weld bead 20.

It should be noted that body 1 of the stabilizer is made of a high strength alloy steel. This steel typically includes, in addition to carbon, one or more of the following alloy constituents: manganese, chromium, nickle, molybdenum, although other constituents are also sometimes employed. In all events, when such metal is welded, the temperature must be carefully controlled to prevent the weld from cracking when it cools. Also, the environment must include an inert gas atmosphere and be kept as pure or clean as possible. If contaminates get into the weld, this will cause cracks to appear, as well.

On the other hand, low carbon steel alloys do not tend to crack when quenched or cooled rapidly. Furthermore, high quality welds can be made without the rigid controls required for high strength steels. Although more material is usually required for a comparably used structure to make it strong enough for the same service conditions, welds in such materials tend to be free of cracks and the steel itself does not undergo heat treatment such as with the high strength alloy steels previously mentioned. By making sleeve 10 of such material it is "easily weldable" as contrasted to the steel of body 1.

To complete the assembly shown in FIG. 1, a long sleeve 22, having an inside diameter for snugly fitting over body 1 adjacent short sleeve 18, is slipped over the body into the position shown. This sleeve includes a plurality of wear elements or blades 24 spaced about the periphery. These blades are typically beveled at their leading and trailing edges, are hard surfaced and may be on hole bore contact surfaces for maximum wear qualities. The abutting surfaces of long sleeve 22 and short sleeve 18 are then welded together by weld bead 26. It should be noted that weld bead 26 does not penetrate the thickness of either sleeve 22 or sleeve 18 to a depth where the weld reaches into or even touches the surface of body 1. Therefore, all of the welding takes place in easily weldable material which does not require welding under closely controlled temperature and clean air conditions.

When one or more of the wear element surfaces of sleeve 22 becomes worn, damaged or otherwise it is indicated that they should be replaced, weld 26 is broken to release the junction and sleeve 22, including the damaged or worn wear elements 24, is removed. A new sleeve 22 with new or reworked elements is replaced and a new weld 26 is made, as previously described. If the wear elements on the removed collar can be reworked or replaced, this can now be done in a clean and temperature-controlled environment without taking the drill string member with its new sleeve out of service.

Alternatively to the sleeves shown in FIG. 1, either or both sleeves 18 and 22 may be partial sleeves or made up of two or more partial sleeves welded together.

FIG. 3 shows an alternate scheme for providing a suitable easily weldable material for affixing long sleeve 22 thereto. In this embodiment, an effective narrow sleeve is made up by building up weld material 18' while the drill string member is in a controlled environment, as previously described. Again, in affixing a good or new sleeve 22 in place, weld 26 does not completely penetrate either sleeve 22 or weld metal 18' so as to contact the surface of body 1 therebeneath.

FIG. 4 illustrates yet another embodiment of the present invention. In this embodiment a single long collar or sleeve 28 is employed in connection with a drill string member 1 of similar configuration to that previously described. Sleeve 28 is longer than the longitudinal length of wear elements 30 to be attached thereto and surrounds and fits so that its upper end is adjacent shoulder 16 of drill string member 1. As with sleeve 22 of the FIG. 1 embodiment, sleeve 28 may be either a closely fitted sleeve or heat shrunk thereon. In fact, it also may be made up of two or more separate pieces which are joined together. In all events, sleeve 28 is secured to drill string member 1 by weld bead 32 at its upper end (adjacent shoulder 16) and by weld bead 34 at its lower end. These welds are each made in a clean and temperature and inert-gas controlled environment to protect against the creation of weld cracks.

Separate wear elements 30 are attached about the periphery of sleeve 28 at an appropriate angle, as shown, via weld beads 36 along the elongated sides of these wear elements. It should be noted that these wear elements are elongated and bevelled at both their leading and trailing edges and are hard faced or surfaced. The welds are made to sleeve 28 but not through them to the underlying surface of member 1. As with the other embodiments previously described, the material of sleeve 28 is easily weldable in a field environment and the welds, even when made in such environment, are not subject to cracking.

When a wear element 30 is damaged or becomes excessively worn, welds 36 are machined or torch-cut away to remove the used element. A new or reworked element 30 is then placed in position and new welds 36 are made, as shown. If only one of the blades needs replacement, then only that blade is replaced.

FIG. 6 is an alternative embodiment to that shown in FIG. 4. In this embodiment, an effective sleeve 28' is built up underneath the area where wear elements 30 are to be attached. Sleeve 28 (or 28') is sufficiently thick so that weld 24 does not penetrate and damage underlying body 1. Removal and replacement of an old element is accomplished in the same manner as previously discussed. It may been seen that the replacement welds are made in easily weldable material and, therefore, there is no need to have a closely controlled environment.

It may be seen that sleeve 28' discussed above has been illustrated and described as being entirely around the drill string member. However, a sleeve that only partially surrounds the member and is controllably welded thereto to form an underlying base of easily weldable material for the wear elements to be attached, is suitable as an alternative to that which is described above.

The discussion above pertains to embodiments of the invention including a sleeve or partial sleeve for welding thereto the replaceable wear elements or wear element assembly. FIG. 7 shows yet another embodiment of the invention which has advantages of attaching replaceable wear elements, even under closely controlled conditions. The view is shown a longitudinal cross section of the blade portion thereof.

Cracks which occur in welded blade stabilizer bodies are often caused by damage of the high strength body material when welding blades or wear elements to the body. When used or damaged elements are removed and new wear elements are welded to the previously welded areas, the damage is accumulative and irreversible.

The stabilizer's body is subjected to bending stresses in service. Stresses in the body are greatest close to the ends of the wear elements. This stress concentration effect is caused by the change of stiffness where the body is no longer supported by the wear elements. Hence, most cracks occur close to the end of the wear elements.

The embodiments shown in FIG. 7 provides a section of built-up weld material 40 in a reduced portion of the stabilizer body just below shoulder 16. This section, which equates with a section of a sleeve as discussed with the previous embodiments, underlies the top end of the wear element and is only built-up to the extent that it restores the original dimension of the stabilizer body. The wear element lies snugly on top thereof, as shown.

In like fashion, another section 42 of built-up weld material in a reduced portion of the stabilizer body lies just above shoulder 17, which is similar to shoulder 16 at the top. This section underlies the bottom end of the wear element and also is only built-up to the extent that it restores the original dimension of the stabilizer body. There is a large area of stabilizer body underneath the wear element between the built-up material sections. It also may be noted that the body of the stabilizer can be reduced or not at a distance above shoulder 16 and/or below shoulder 17, as desired.

The structure just described will permit the wear elements at the factory or otherwise under controlled environmental conditions to be welded to the high strength material of the body of the stabilizer by elongate weld beads in the area between sections 40 and 42 and then to be conveniently welded by extension of these beads in these sections 40 and 42 of easily weldable material. Therefore, this embodiment provides a way of reducing body cracking where the stresses mostly occur. Although this structure will not eliminate the need for pre-heating before welding and post-heating afterward because the center section of the wear element is welded to the body material, the construction still may be preferred because of the cost advantages in manufacturing and because of the elimination of crack problems where most cracks occur.

Although numerous embodiments have been shown and described, it will be understood that the invention is not limited thereto since many modifications may be made and will become apparent to those skilled in the art.

What is claimed is:

1. A drill string stabilizer including a replaceable wear element for contacting the surface of the borehole during drill string operation, comprising a sleeve suitable for at least partially surrounding a high strength alloy steel drill string member, said sleeve having at least a portion made of easily weldable material, said sleeve being welded to said drill string member, said replaceable wear element being replaceable welded to the easily weldable material of said sleeve.

2. A drill string stabilizer in accordance with claim 1, wherein said replaceable wear element is included in a second sleeve that at least partially surrounds said drill string member and abuts said first-named sleeve, and wherein said sleeves are replaceably welded by at least one weld bead that penetrates the surfaces of said sleeves without penetrating the surface of the underlying drill string member.

3. A drill string stabilizer in accordance with claim 1, wherein said easily weldable material portion of said sleeve is low carbon steel.

4. A drill string stabilizer in accordance with claim 1, wherein said easily weldable material portion of said sleeve is weld material.

5. A drill string stabilizer in accordance with claim 1, wherein said sleeve comprises easily weldable material underlying a portion of the ends of said replaceable wear element and not therebetween.

6. A drill string stabilizer in accordance with claim 5, wherein said replaceable wear element is controllably welded along its elongated sides to the drill string member.

7. A drill string stabilizer in accordance with claim 1, wherein said sleeve underlies said replaceable wear element, said replaceable wear element being welded with at least one weld bead that penetrates the surface of said sleeve without penetrating the surface of the underlying drill string member.

8. A drill string stabilizer in accordance with claim 7, wherein said sleeve is welded forward and rearward of said replaceable wear element to said drill string member.

9. A drill string stabilizer in accordance with claim 7, wherein said replaceable wear element is substantially elongate with said drill string member, wherein said weld bead is along one elongate side of said wear element, and including a second elongate weld bead along the opposite side of said wear element.

10. A drill string stabilizer in accordance with claim 7, wherein said sleeve is low carbon.

11. A drill string stabilizer in accordance with claim 7, wherein said sleeve is weld material.

12. A drill string in accordance with claim 7, and including at least another replaceable wear element overlying said sleeve circumferentially displaced from said first-named replaceable wear element, said another replaceable wear element being welded with at least one weld bead that penetrates the surface of said sleeve without penetrating the surface of the underlying drill string member.

13. A process for producing a drill string stabilizer, including at least one replaceable wear element, which comprises providing a sleeve for at least partially surrounding a high-strength alloy steel drill string member, said sleeve having at least a portion made of easily weldable material, welding said sleeve to said drill string member, and welding a replaceable wear element to the easily weldable material of said sleeve and not to said drill string member.

14. The process in accordance with claim 13, wherein said replaceable wear element is included in a second sleeve that at least partially surrounds said drill string member and abuts said first-named sleeve, and wherein said welding penetrates the surfaces of said sleeves without penetrating the surface of the underlying drill string member.

15. The process in accordance with claim 13, wherein said sleeve underlies said replaceable wear element, and wherein said welding penetrates the surface of said sleeve without penetrating the surface of the underlying drill string member.

16. The process in accordance with claim 15, and including welding additional replaceable wear elements to the easily weldable material of said sleeve and not to said drill string member at additional locations circumferentially displaced about said drill string member from said first-named replaceable wear element.

* * * * *